US008070518B2

(12) United States Patent
Akino

(10) Patent No.: US 8,070,518 B2
(45) Date of Patent: Dec. 6, 2011

(54) CONNECTOR FOR CAPACITOR MICROPHONE

(75) Inventor: Hiroshi Akino, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 0 days.

(21) Appl. No.: 12/892,149

(22) Filed: Sep. 28, 2010

(65) Prior Publication Data

US 2011/0086547 A1 Apr. 14, 2011

(30) Foreign Application Priority Data

Oct. 14, 2009 (JP) ..... 2009-237258

(51) Int. Cl.
*H01R 9/03* (2006.01)

(52) U.S. Cl. ..... 439/607.41

(58) Field of Classification Search ..... 439/607.41, 439/941, 98–99, 108
See application file for complete search history.

(56) References Cited

U.S. PATENT DOCUMENTS 7,390,221 B2 * 6/2008 Akino ..... 439/607.17
7,500,878 B2 * 3/2009 Akino ..... 439/607.41
2007/0238358 A1 * 10/2007 Akino ..... 439/610
2009/0104815 A1 * 4/2009 Reker ..... 439/607.41
2009/0203256 A1 * 8/2009 Mathews ..... 439/583

FOREIGN PATENT DOCUMENTS

JP 2006-67165 3/2006
JP 2007-300598 11/2007

* cited by examiner

*Primary Examiner* — Jean Duverne
(74) *Attorney, Agent, or Firm* — Whitham Curtis Christofferson & Cook, PC

(57) ABSTRACT

A compression sleeve is combined to a microphone cable. A small-diameter cylindrical portion is compressed on the outer peripheral side of a folded portion of a shielding cable. Thus, the compression sleeve is electrically connected to the shielding cable. A large-diameter cylindrical portion covers a connection portion between a connector and the microphone cable. The large-diameter cylindrical portion and a connector housing are fitted with each other. A bush covers the compression sleeve. Inner periphery of the connector housing is in contacts and presses the outer periphery of the large-diameter cylindrical portion. The large-diameter cylindrical portion has a flange on the outer surface. The flange contacts and presses an end of the connector housing on closer to the microphone cable by the shoulder portion of the bush.

3 Claims, 7 Drawing Sheets

RELATED ART

CONNECTOR FOR CAPACITOR MICROPHONE

BACKGROUND OF THE INVENTION

1. The present invention relates to a connector for a capacitor microphone and in particular to a shielding structure and a shielding method of such a connector.

2. Description of the Related Art

Capacitor microphones have high impedance microphone units and thus an impedance converter including a field-effect transistor (FET) is used therein.

In tie pin microphones and gooseneck microphones, a microphone is made less noticeable with the following structure. An impedance converter is incorporated in a microphone unit. A low-cut circuit and an output circuit axe stored in a circuit storage provided separately with the microphone unit, and the microphone unit and the circuit storage are connected to each other via, a dedicated microphone cable. The microphone unit converts sound into an electric signal. The sound signal thus made is transmitted to the circuit storage to be output from the output circuit therein. The circuit storage incorporating the low-cut circuit and the output circuit is referred to as a power module.

The dedicated microphone cable connecting the microphone unit to the power module is a two-core shielding cable formed of: a power wire through which power is supplied to the capacitor microphone; a signal wire through which a sound signal output from the impedance converter is fed to the power module; and a shielding cable for electric shielding and grounding the wires.

The sound signal, which is transmitted through the dedicated microphone cable in ah unbalanced state, is vulnerable to external noise, i.e., is easily affected by external electromagnetic, waves. Specifically, electro-magnetic waves reaching the dedicated microphone cable from the exterior enters the microphone unit or the power module through the microphone cable. Then, the electromagnetic waves are detected by a semiconductor element forming the microphone unit or the power module to be mixed into the sound signal as noise.

An output from the microphone is output, from the power module through the balanced shielding cable. Still, if strong electromagnetic waves are, applied to the microphone or the output cable of the microphone, high frequency current enters the microphone through the microphone cable and via a microphone connector and is demodulated in the impedance converter to be output from the microphone as noise in an audible frequency level.

The microphone cable can be attached and detached to and from the microphone via a threepin type microphone connector (a connecter specified in EIAJ RC-5236 "Latch Lock Type Round Connector for Acoustic Equipment". First to third pins of the threepin type microphone connector are generally used for grounding, a hot side of a signal, and a cold side of a signal, respectively.

In a connector mounted oh a general microphone cable, core wires and a shielding cable of the cable are directly connected to male and female parts, of the connector that are in contact with each other by means of soldering and the like, and the first pin is connected to a housing of the connector made of metal through a lead wire. Accordingly, impedance for high frequency waves is present between the shield of the microphone cable and the connector housing allowing the high frequency current to enter therethrough.

FIG. 4 exemplary illustrates a conventional connector of a capacitor microphone used for a dedicated microphone cable. In FIG. 4, the reference numeral 10 denotes the connector.

The connector 10 is a female connector and is electrically connected to a male connector of a microphone not illustrated when the male connector of the microphone is inserted therein. The connector 10 is of a threepin type and includes: three pins that fit the male connector of the microphone; and terminal plates that are electrically integrated with the pins and protrude from the rear end of the connector 10. Core wires 23 and 24 and a shielding cable 22 on one side of the microphone cable 20 are connected to the respective terminal plates by means of soldering. The microphone cable 20 is passed through an insulating sleeve 60, a sleeve 70, and a bush 40 in this order at its outer periphery.

The insulating sleeve 60 has an outer diameter substantially the same as that of the connector 10 and covers the connection, portion between one end of the microphone cable 20 and the connector 10 to protect the connection portion and prevent short-circuit thereat. The sleeve 70 includes a cylindrical part 71 having an inner diameter substantially the same as the outer diameter of the sleeve 60 and covers the connection portion between one end of the microphone cable 20 and the connector 10 with a certain space provided therearound, and claws 72 for compressing the outer peripheral surface of the microphone cable 20, the surface formed of an insulating cover, to allow the sleeve 70 to be integrally connected to the microphone cable 20. The bush 40 includes a root portion 41 of a tapered shape having the inner diameter slightly larger than the outer diameter of the microphone cable 20 and a cover 42 that has a diameter larger than that of the root section 41 and can cover the sleeve 70.

The connector 10 is fitted in a cylindrical connector housing 50 that is long enough to cover the connector 10, the insulating sleeve 60, and the cylindrical part 71 of the sleeve 70. Outer periphery on the rear side of the connector housing 50 fits the inner periphery on the front side of the bush 40.

FIGS. 4A to 4C illustrate an assembling sequence. As illustrated in FIG. 4A, the connector 10 and the microphone cable 20 are connected with each other with the terminal plates of the connector 10 soldered to the respective wires and the cable of the microphone cable 20. The microphone cable 20 is so passed through the insulating sleeve 60 and the sleeve 70 before or after the soldering that the front end of the insulating sleeve 60 abuts the rear end of the connector 10, and the front end of the cylindrical part 71 of the sleeve 70 abuts the rear end of the insulating sleeve 60, whereas the claws 72 of the sleeve 70 is compressed to connect the sleeve 70 to the microphone cable 20 as illustrated in FIG. 4B. Then, the outer periphery on the rear side of the connector housing 50 covering the connecter 10, the insulating sleeve 60, and the sleeve 70 is fitted to the inner periphery on the front side of the bush 40, thereby integrating the connector housing 50 and the bush 40. Thus, the connector is formed with the connector hosing 50 and the bush 40 as well as the connector 10, the insulating sleeve 60, the sleeve 70, and the microphone cable 20 integrally connected.

In the conventional example illustrated in FIGS. 4A to 4C, a shielding structure is provided to the connector portion by connecting the shielding cable 22 to the sleeve 70 that fixes the microphone cable 20 to internally connect the shielding cable 22 to the connector housing 50. The shielding cable 22 of the microphone cable 20 and the connector housing 50 are electrically discontinuous because the insulating sleeve 60 and the sleeve 70 are provided between the microphone cable 20 and the connector housing 50. Unfortunately, the discontinuous portion serves as a hole (an opening) for external high-frequency wave and electromagnetic waves passes therethrough.

FIG. 5 illustrates a shielding structure for a microphone cable that is proposed to solve the problem the conventional example illustrated in FIGS. 4A to 4C has. In FIG. 5, one end of the shielding cable 22 of the microphone cable 20 covering the core wires is folded in the opposite direction to be placed on a sheath of the microphone cable 20. This folded portion 21 is passed through a small-diameter cylindrical part 81 of a sleeve 80. The sleeve 80 and the shielding cable 22 are electrically connected and the sleeve 80 and the microphone cable 20 are connected by compressing the small-diameter cylindrical part 81. The sleeve 80 also includes a large-diameter cylindrical part 83 having an outer diameter substantially the same as the inner diameter of the connector housing 50 at the rear end. The connector housing 50 fits the outer periphery of the large-diameter cylindrical part 83 to make the sleeve 80 electrically connected to the connector housing 50.

The conventional example illustrated in FIG. 5 aims to provide higher shielding effect compared with that provided by the conventional example illustrated in FIG. 4 by providing continuous shielding structure by electrically connecting the sleeve 80 and the connector housing 50. Unfortunately, the connection can be no more than a point contact and sufficient shielding effect cannot be provided because the connector housing 50 and the sleeve 80 only have their opposing end surfaces pressed against each other.

FIG. 6 illustrates a shielding structure of a microphone connector disclosed in Japanese Patent Application Publication No. 2006-67165. In FIG. 6, a structure is proposed in which the connector housing 50 and the bush 40 are integrated by fitting the outer periphery oh the rear side of the connector housing 50 covering the connector 10, the insulating sleeve 60, and a large-diameter cylindrical part 31 of a compression sleeve 30 to the inner periphery on the front side of the bush 40. In the connector with such a structure, the integral connection of the connector housing 50 and the bush 40 is accompanied by the integral connection between the connector 10, the insulating sleeve 60, the compression sleeve 30 and the microphone cable 20. In this conventional example, the connection portion of the connector 10 and the microphone cable 20 is covered by the large-diameter cylindrical part 31 of the compression sleeve 30. A small-diameter cylindrical part 32 of the compression sleeve 30 is fitted to the outer peripheral side of the folded portion of the shielding cable 22 at the end of the microphone cable 20 and is compressed to be electrically connected to the shielding cable 22 of the microphone cable 20. The large-diameter cylindrical part 31 of the compression sleeve 30 is fitted to the connector housing 50. All things considered, the connection portion between the connector 10 and the microphone cable 20 is continuously shielded from the shielding cable 22 of the microphone cable 20 to the connector housing 50. Thus, the shielding effect is increased.

A structure is proposed with an invention disclosed in Japanese Patent Application Publication No. 2007-300598 in which, in addition to the structure described in Japanese Patent Application Publication No. 2006-67165 illustrated in FIG. 6, the large-diameter cylindrical part 31 of the compression sleeve 30 and the connector housing 50 are fitted to each other with the sleeve 70 that is conductive and is made of an elastic material and having a cross-sectional, shape of a wave form provided therebetween. The sleeve 70 that is conductive electrically connects the compression sleeve 30 and the connector housing 50 integrally at multiple points. Furthermore, a structure is proposed in which the shield is galvanically separated by using a capacitor sleeve having a capacitor structure in stead of the sleeve 70 that is conductive.

In the inventions disclosed in Japanese Patent Application Publication No. 2006-67165 and Japanese Patent Application Publication No. 2007-300598, the shield is formed by connecting the outer periphery of the compression sleeve 30 to the inner periphery of the connector housing 50. Therefore, electro-magnetic waves may enter the connector housing 50 through gaps between the connector housing 50 and the bush 40 and between the bush 40 and the compression sleeve 30 as illustrated in FIG. 6 with arrows A. Electro-magnetic waves can enter through whatever gap formed in an apparatus as illustrated with the arrows A like liquid entering through a gap. The entrance of electro-magnetic waves leads to the generation of noise in the microphone.

Less attention being paid on shielding at the connector as described above is resulting in the entrance of electro-magnetic waves through the connection portion to have noise mixed into a sound signal.

Due to recent spread of cell phones, electro-magnetic waves of a high frequency exist everywhere in our daily lives. Thus, chances of a high frequency signal entering the microphone cable through its connector to have noise mixed into a sound signal is increasing. Capacitor microphones are especially vulnerable to the high frequency signal from a cell phone used nearby and the high frequency signal entering through the connection portion turns into noise.

SUMMARY OF THE INVENTION

The present invention is made to solve the above problems in the conventional examples and an object of the present invention is to provide a connector for a capacitor microphone with which electro-magnetic waves are surely prevented from entering the connector and can prevent noise from mixing into a sound signal generated by conversion into electrical signal by the microphone.

According to an embodiment of the present invention, a connector for a capacitor microphone comprises: a compression sleeve that is made of shielding material and includes a small-diameter cylindrical portion and a large-diameter cylindrical portion; a microphone cable including a core wire, a shielding cable, and, at one end, a folded portion of the shielding cable; a connector to which the core wire and the shielding cable of the microphone cable are connected; a connector housing that covers the connector; and a bush that is fitted with the connector housing and includes a shoulder portion on inner periphery, the shoulder portion being connected to the large-diameter cylindrical portion of the compression sleeve. The small-diameter cylindrical portion of the compression sleeve is fitted to outer peripheral side of the folded portion of the shielding cable at the end of the microphone cable and compressed to make the compression sleeve electrically connected to the shielding cable and combined to the microphone cable. The large-diameter cylindrical portion of the compression sleeve covers the connection portion between the connector and the microphone cable. The large-diameter cylindrical portion of the compression sleeve and the connector housing are fitted with each other. The bush covers the compression sleeve, inner periphery of the connector housing is in contact with outer periphery of the large-diameter cylindrical portion of the compression sleeve. The large-diameter cylindrical portion of the compression sleeve has a flange on the outer periphery, the flange being sandwiched by one end of the connector housing and the shoulder portion of the bush.

The large-diameter cylindrical part of the compression sleeve of the connector for a capacitor microphone has the flange on the outer peripheral surface facing the microphone cable. The flange is sandwiched and pressed by the end of the connector housing closer to the microphone cable end of the connector housing and the shoulder portion at the inner periphery of the bush. Thus, electro-magnetic waves, especially those with high frequencies, are prevented from entering the connector housing through a gap. Furthermore, the shielding cable of the microphone cable is surely connected to the connector housing electrically without forming any openings. Thus, this structure contributes to the improvement, of the shielding effect of the entire connector.

DETAILED DESCRIPTION OF THE PREFERRED EMBODIMENTS

Figures 1A, 1B, 1C:
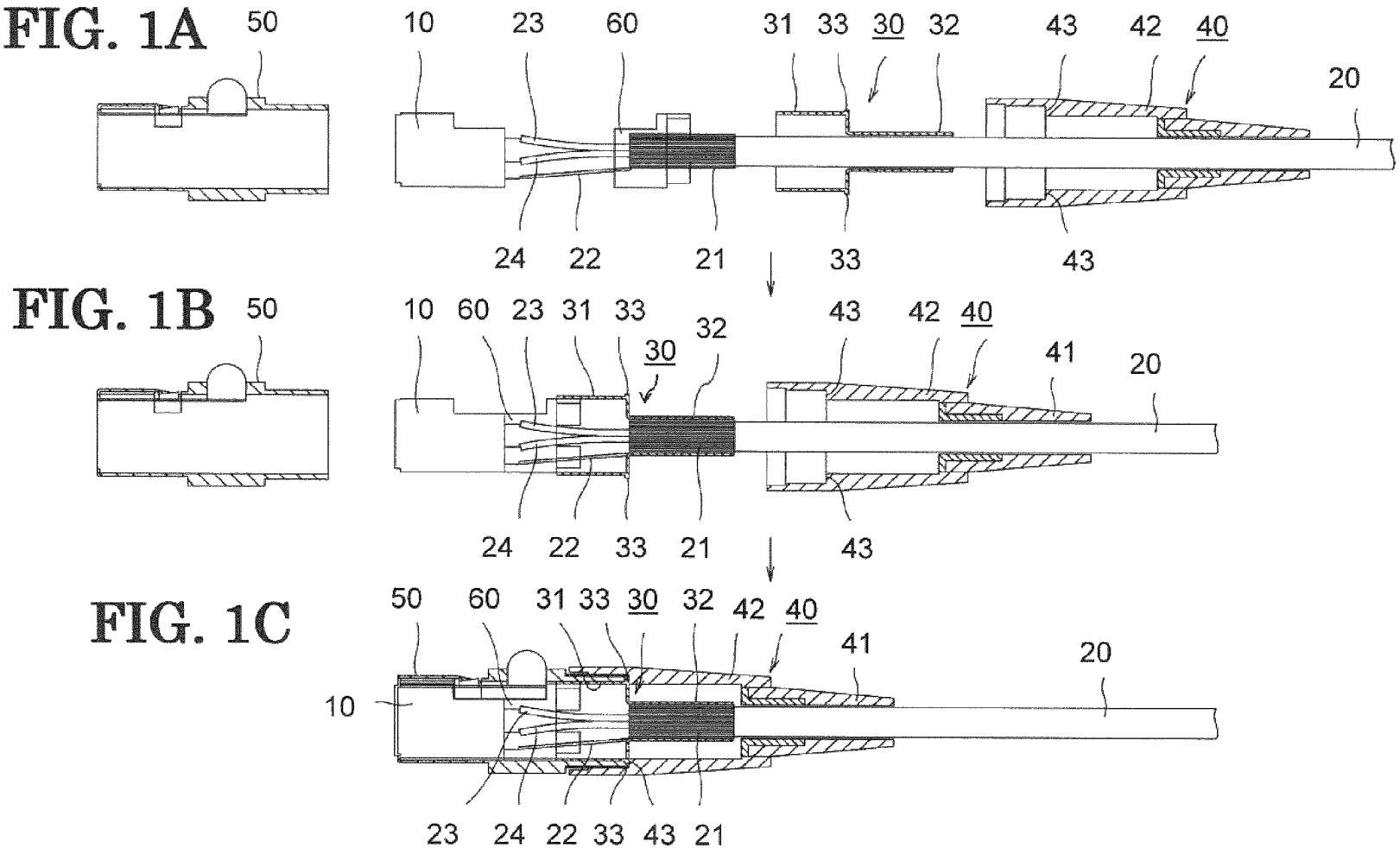
FIGS. 1A to 1C are cross-sectional views illustrating an embodiment of a connector for a capacitor microphone according to the present invention in the order of assembling.

An embodiment of a connector for a capacitor microphone according to the present invention is described below with reference to some of the accompanying drawings. In the embodiment of the present invention illustrated in FIGS. 1 to 3, same elements as those in the conventional examples illustrated in FIGS. 4 to 7 are given the same reference numerals. The feature of the connector for a capacitor microphone according to the present invention mainly lies in the shape of a compression sleeve and structures of a connector housing and a bush. Other structures in the embodiment of the connector according to the present invention are substantially the same as those described in Japanese Patent Application Publication 2006-67165. However, the present invention is not limited thereto.

Figure 2:
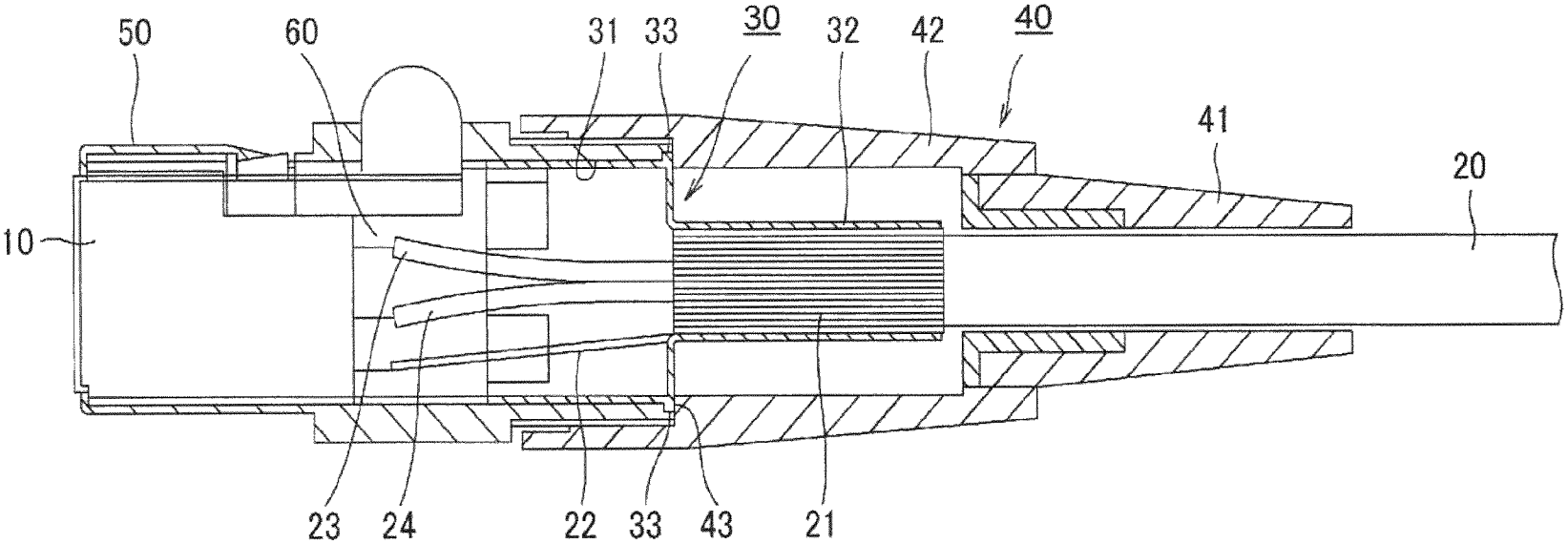
FIG. 2 is a cross-sectional view illustrating the embodiment of the connector for a capacitor microphone according to the present invention in the assembled stated.

In FIGS. 1 and 2, reference numeral 10 denotes a connector. The connector 10 is a female connector and is electrically connected to a non-illustrated male connector, such as that of a microphone, when the male connector of the microphone is inserted therein. The connector 10 is of a threepin type and includes: three pins that fit the male connector of the microphone; and terminal plates that are electrically integrated with the respective pins and protrude from the rear end of the connector 10. Core wires 23 and 24 and a shielding cable 22 on one side of a microphone cable 20 are connected to the respective terminal plates by means of soldering. The microphone cable is passed through an insulating sleeve 60, a compression sleeve 30, and a bush 40 in this order at its outer periphery side.

The insulating sleeve 60 surrounds connection portion between one end of the microphone cable 20 and the connector 10 together with a later described large-diameter cylindrical part 31 of the compression sleeve 30. Specifically, the connection portion covers the area starting from the rear end of the connector 10 to the front end of a folded portion 21 of the shielding cable 22 of the microphone cable 20. Thus, the connection portion is protected and short circuiting is prevented from occurring thereat. The insulating sleeve 60 has the outer diameter substantially the same as that of the connector 10. The protection is provided not only by the above structure but may also be provided by covering the connection portion between the connector 10 and the microphone cable 20 with the large-diameter cylindrical part 31 as in the conventional example illustrated in FIG. 5 and the insulating sleeve 60 may not be provided.

The compression sleeve 30 includes the large-diameter cylindrical part 31 and a small-diameter cylindrical part 32. A step portion extending in a radial direction is provided between the large-diameter cylindrical part 31 and the small-diameter cylindrical part 32. The compression sleeve 30 is made of a shielding material, i.e., a conductive material to serve as a shielding member. The large-diameter cylindrical part 31, which have the outer diameter substantially the same as that of the insulating sleeve 60, surrounds the connection portion between the end of the microphone cable 20 and the connector 10 with a certain space provided therearound. The inner diameter of the small-diameter cylindrical part 32 is slightly larger than the outer diameter of the microphone cable 20. At the end of the microphone cable 20, the shielding cable 22 covering the core wires 23 and 24 is folded in the opposite direction. Thus, the shielding cable 22 covers the sheath of the microphone cable 20. Thus, the folded portion 21 is formed. The small-diameter cylindrical part 32 of the compression sleeve 30 is provided on the outer periphery of the folded portion 21. The compression sleeve 30 and the shielding cable 22 are electrically connected and the compression sleeve 30 is combined to the microphone cable 20 by compressing, the small-diameter cylindrical part 32.

The large-diameter cylindrical part 31 of the compression sleeve 30 has a flange 33 at its outer periphery. The flange 33 of the large-diameter cylindrical part 31 is a protrusion with a ring shape and surrounding the entire circumference of the outer periphery of the large-diameter cylindrical part 31 at a portion of the outer periphery of the step portion formed between the large-diameter cylindrical part 31 and the small-diameter cylindrical part 32. The bush 40 includes a root portion 41 having a tapered shape and the inner diameter slightly larger than the outer periphery of the microphone cable 20, a cover portion 42 that can cover the compression, sleeve 30 and has the diameter larger than that of the root portion 41, and a shoulder portion 43 designed to press the flange 33 of the compression sleeve 30. As illustrated in FIG. 2, the shoulder portion 43 of the bush 40 is a step portion at which the inner diameter of the bush 40 is made smaller than the outer diameter, of the large-diameter cylindrical part 31. Therefore, the end of the large-diameter cylindrical part 31 closer to the microphone cable can be pressed by the shoulder portion 43 upon fitting the bush 40 with the compression sleeve 30. The inner diameter of the bush 40 on the connector 10 side is substantially the same with the outer diameter of the large-diameter cylindrical part 31. The shoulder portion 43 is provided at an appropriate portion on the bush 40 in the length direction for the outer surface of the large-diameter cylindrical part 31 of the compression sleeve 30 to be covered with the bush 40.

Figure 3:
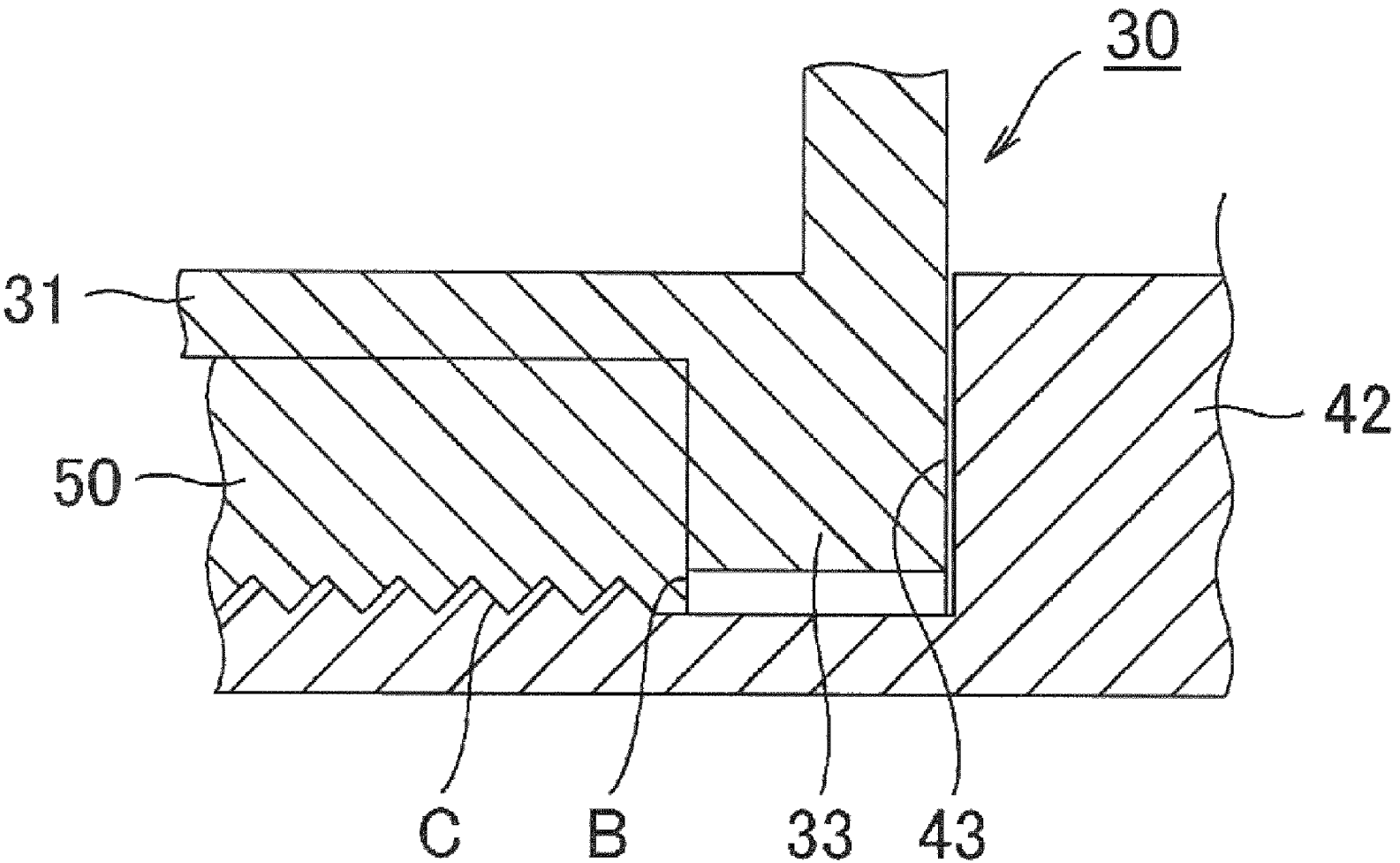
FIG. 3 is a partially enlarged cross-sectional view of the connector of a capacitor microphone according to the embodiment.
Figures 4A, 4B, 4C:
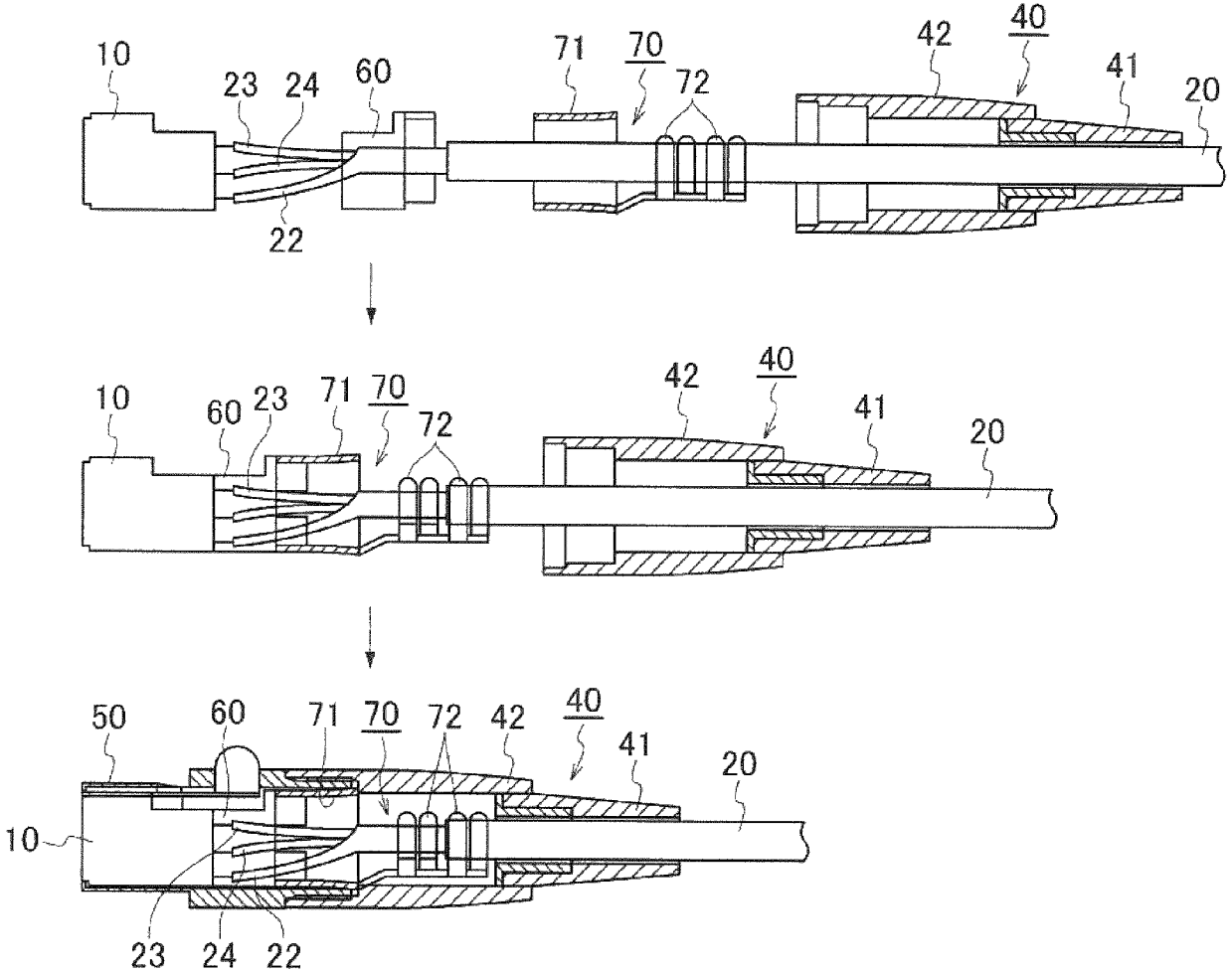
FIGS. 4A to 4C are cross-sectional views illustrating an example of a conventional connector for a capacitor microphone in the order of assembling.
Figure 5:
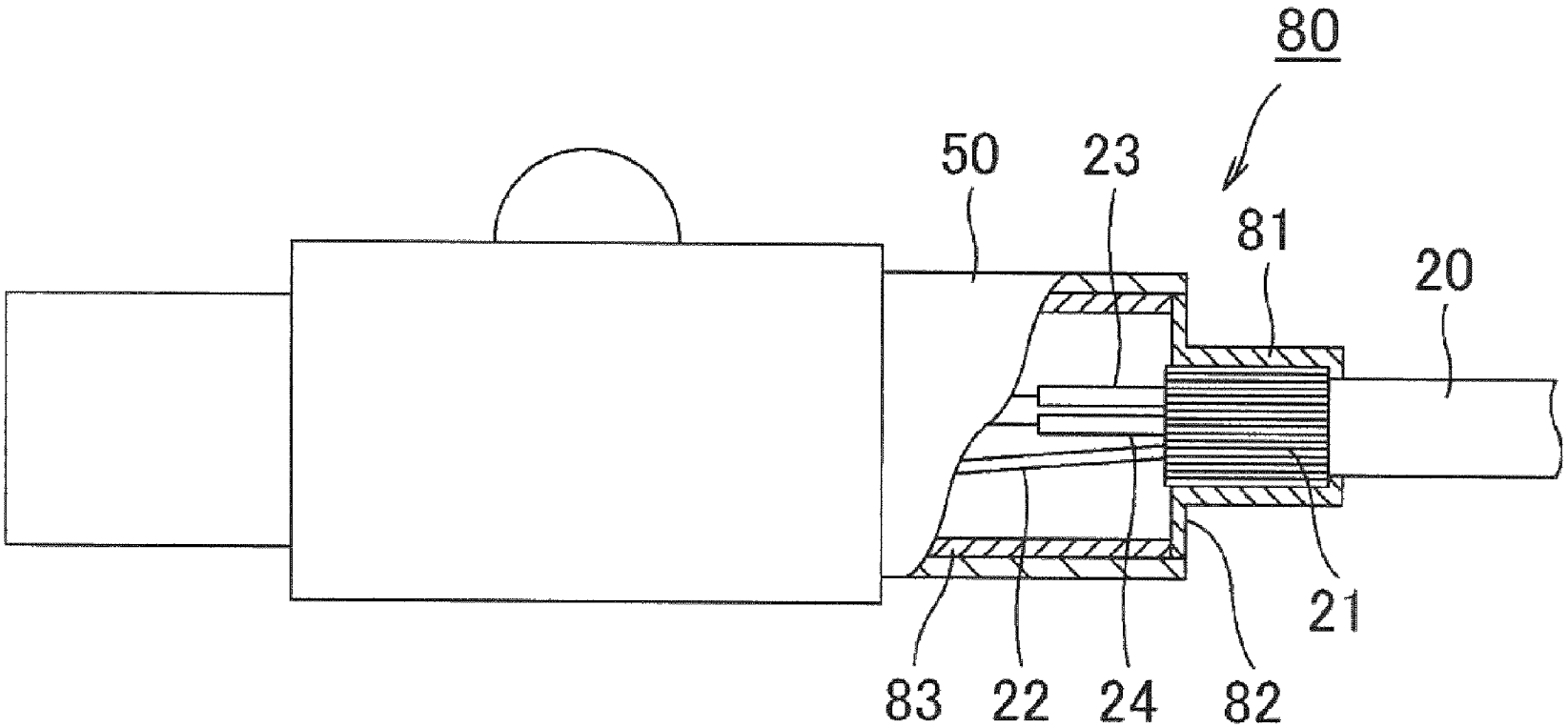
RELATED ART FIG. 5
FIG. 5 is a partial cross-sectional side view of another example of a conventional connector for a capacitor microphone.
Figure 6:
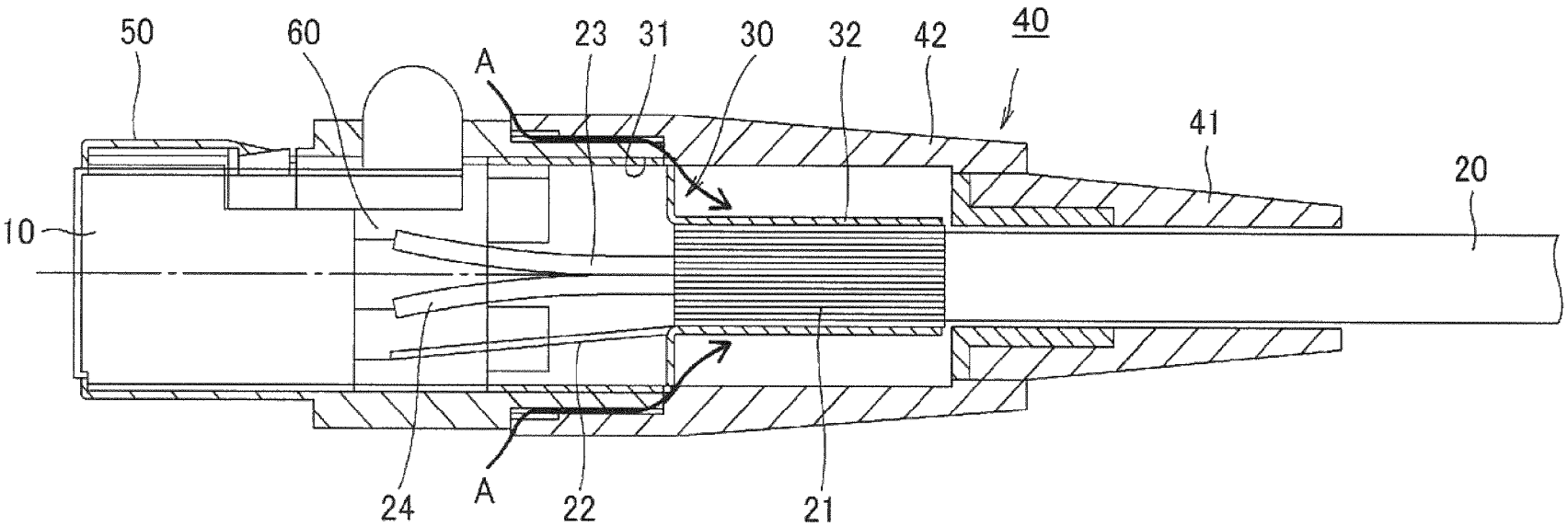
RELATED ART FIG. 6
FIG. 6 is a cross-sectional, side view of still another example of a conventional connector for a capacitor microphone.
Figure 7:
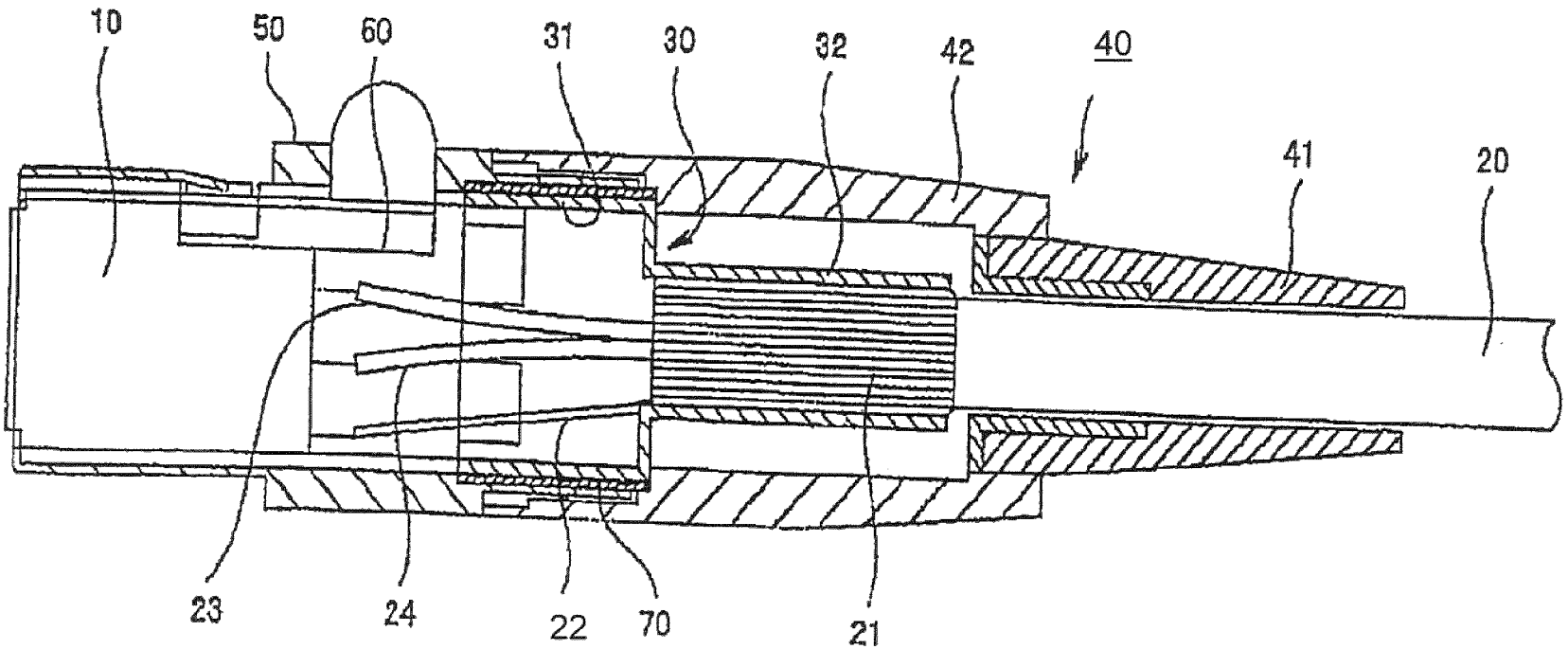
RELATED ART FIG. 7
FIG. 7 is a cross-sectional side view of yet still another example of a conventional connector for a capacitor microphone.

The connector 10 is fitted to the inner peripheral of the connector housing 50 having a cylindrical shape. The connector housing 50 is long enough to cover the connector 10, the insulating sleeve 60, and the large-diameter cylindrical part 31 of the compression sleeve 30. In the assembled state, the flange 33 of the compression sleeve 30 is sandwiched and pressed by the end of the connector housing 50 closer to the microphone cable 20 and the shoulder portion 43 of the bush 40 as shown in FIGS. 2 and 3. If the flange 33 is integrally formed on the compression sleeve 30 by so called lathe processing, streaky machining scars on a contact surface B between the connector housing 50 and the flange 33 in FIG. 3 matches well to provide higher shielding effect against electro-magnetic waves. Three dimensional figure of the flange 33 can be selected as appropriate. Still, the contact surface for the connector housing 50 is preferably flat in terms of preventing entrance of electro-magnetic waves. The connector housing 50 and the bush 40 are preferably connected to each other through screwing as illustrated in the portion denoted with C in FIG. 3 to be engaged more firmly.

With the above structure, electro-magnetic waves, especially those having high frequency emitted from, for example, a cell phone can be prevented from entering the connector housing 50 through gaps formed between the connector housing 50 and the bush 40 and between the bush 40 and the compression sleeve 30 and the like. This structure surely connects the shielding cable 22 of the microphone cable 20 to the connector housing 50 electrically without forming any openings and thus contributes to the improvement of the shielding effect of the entire connector.

FIGS. 1A to 1C illustrate an assembling order. As illustrated in FIG. 1A, the connector 10 and the microphone cable 20 are connected with each other with the terminal plates of the connector 10 soldered to the respective wires and cable of the microphone cable 20. The microphone cable 20 is so passed through the insulating sleeve 60 and the compression sleeve 30 before or after the soldering that the front end of the insulating sleeve 60 abuts the rear end of the connector 10. Then, the inner peripheral on the front side of the large-diameter cylindrical part 31 of the compression sleeve 30 is fitted to the outer peripheral on the rear side of the insulating sleeve 60. At the same time, the small-diameter cylindrical part 32 of the compression sleeve 30 is fitted to the folded portion 21 of the shielding cable 22 of the microphone cable 20 in a surrounding manner. Then, the small-diameter cylindrical part 32 of the compression sleeve 30 is compressed to combine the compression sleeve 30 with the microphone cable 20 while the shielding cable 22 of the microphone cable 20 is connected with the compression sleeve 30 to be electrically integrated with each other as illustrated in FIG. 1B.

Then, as illustrated in FIG. 1C, the inner-periphery on the front side of the bush 40 is fitted with the outer periphery on the rear side of the connector housing 50 covering the connector 10, the insulating sleeve 60, and the large-diameter cylindrical part 31 of the compression sleeve 30, to integrally connect the connector housing 50 with the bush 40. Thus, the integral connection of, the connector housing 50 and the bush 40 accompanied by the integral connection between the connector 10, the insulating sleeve 60, the compression sleeve 30 and the microphone cable 20 is provided. As illustrated in FIGS. 2 and 3, the flange 33 formed on the outer periphery of the compression sleeve 30 is sandwiched by one end of the connector, housing 50 and the shoulder portion 43 of the bush 40.

In the above described embodiment, electro-magnetic waves, especially those having a high frequency, can be prevented from entering the connector housing 50 through gaps formed between the connector housing 50 and the bush 40 and between the bush 40 and the compression sleeve 30. Furthermore, the embodiment has the following structure: the connection portion between the connector 10 and the microphone cable 20 is covered with the large-diameter cylindrical part 31 of the compression sleeve 30 and the insulating sleeve 60; the small-diameter cylindrical part 32 of the compression sleeve 30 is fitted to the outer peripheral side of the folded portion 21 formed by one end of the shielding cable 22 of the microphone cable 20; the small-diameter cylindrical part 32 is compressed to be electrically connected to the shielding cable 22 of the microphone cable 20; and the large-diameter cylindrical part 31 of the compression sleeve 30 and the connector housing 50 are fitted with each other. The connection portion between the connector 10 and the microphone cable 20, from the shielding cable 22 of the microphone cable 20 to the connector housing 50, are continuously shielded to improve the shielding effect at the connection portion between the connector 10 and the microphone cable 20. The connection portion between the connector 10 and the microphone cable 20 is covered with the compression sleeve 30 including the small-diameter cylindrical part 32 and the large-diameter cylindrical part 31 and having an integrated structure. The small-diameter cylindrical part 32 is compressed to be connected to the shielding cable 22 of the microphone cable 20. The large-diameter cylindrical part 31 and the connector housing 50 are fitted with each other to be electrically connected with each other. Therefore, the shielding cable 22 of the microphone cable 20 is surely electrically connected to the connector housing 50 without forming any openings. This contributes to the shielding effect of the entire connector section.

The step portion expanding in a radial direction formed between the large-diameter cylindrical part 31 and the small-diameter cylindrical part 32 of the compression sleeve 30 also contributes to the improvement of the shielding effect of the entire connector section by effectively blocking high-frequency signals entering from outside. The small-diameter cylindrical part 32 of the compression sleeve 30 is compressed on the folded portion 21 of the shielding cable 22 of the microphone cable 20. This also contributes to the improvement of the shielding effect of the entire connector section by surely connecting the compression sleeve 30 to the shielding cable 22 of the microphone cable 20 to lower the electrical contact resistance.

The present invention may also be structured as a connector for microphones other than capacitor microphones or a connector for apparatuses other than microphones. Still, effect higher than those in the above applications can be provided by being structured as a connector for capacitor microphones that are vulnerable to external high frequency signals as a source of noise. The structure of the connector for a capacitor microphone according to the present invention is not limited to that described above. For example, a sleeve forming a capacitor may be included as in the invention disclosed in Japanese Patent Application Publication No. 2007-300598, or a ring made of conductive cloth may be included.

What is claimed is:

1. A connector for a capacitor microphone, the connector comprising:

a compression sleeve that is made of a shielding material and includes a small-diameter cylindrical portion and a large-diameter cylindrical portion;

a microphone cable including a core wire, a shielding cable, and, at one end, a folded portion of the shielding cable;

a connector to which the core wire and the shielding cable of the microphone cable are connected;

a connector housing that covers the connector; and a bush that is fitted with the connector housing and includes a shoulder portion on inner periphery, the shoulder portion being connected to the large-diameter cylindrical portion of the compression sleeve, wherein the small-diameter cylindrical portion of the compression sleeve is fitted to outer peripheral side of the folded portion of the shielding cable at the end of the microphone cable and compressed to make the compression sleeve electrically connected to the shielding cable and combined to the microphone cable, the large-diameter cylindrical portion of the compression sleeve covers the connection portion between the connector and the microphone cable, the large-diameter cylindrical portion of the compression sleeve and the connector housing are fitted with each other, the bush covers the compression sleeve, inner periphery of the connector housing is in contact with outer periphery of the large-diameter cylindrical portion of the compression sleeve, and the large-diameter cylindrical portion of the compression sleeve has a flange on the outer periphery, the flange being sandwiched by one end of the connector housing and the shoulder portion of the bush.

2. The connector for a capacitor microphone according to claim 1, wherein a step portion extending in a radial direction is foamed between the large-diameter cylindrical portion and the small-diameter cylindrical portion of the compression sleeve, and the flange is formed on the step portion.

3. The connector for a capacitor microphone according to claim 1, wherein the compression sleeve and the flange of the compression sleeve are integrally formed.

* * * * *